US006363990B1

(12) United States Patent
Kozaki

(10) Patent No.: US 6,363,990 B1
(45) Date of Patent: Apr. 2, 2002

(54) COATING FILM TRANSFER TOOL

(75) Inventor: Hiroshi Kozaki, Osaka (JP)

(73) Assignee: Fujicopian Co., Ltd., Osaka (JP)

( * ) Notice: Subject to any disclaimer, the term of this patent is extended or adjusted under 35 U.S.C. 154(b) by 0 days.

(21) Appl. No.: 09/588,431

(22) Filed: Jun. 6, 2000

(30) Foreign Application Priority Data

Jun. 7, 1999 (JP) ..... 11-158916

(51) Int. Cl.[7] ..... B32B 31/00

(52) U.S. Cl. ..... 156/540; 156/577; 156/579; 118/76; 242/160.4; 242/171; 242/588.6

(58) Field of Search ..... 156/577, 574, 156/579, 523, 527, 540, 238; 242/588.2, 588.6, 160.2, 160.4, 588, 170, 588.3, 171; 225/46; 118/76, 200, 257

(56) References Cited

U.S. PATENT DOCUMENTS 5,346,580 A * 9/1994 Elges et al. ..... 156/540
5,759,270 A * 6/1998 Lee ..... 118/200
5,772,840 A * 6/1998 Morinaga ..... 156/540
6,273,169 B1 * 8/2001 Ono et al. ..... 118/257

FOREIGN PATENT DOCUMENTS

JP 8-175738 * 7/1996 ..... B65H/35/07

* cited by examiner

*Primary Examiner*—Mark A. Osele
*Assistant Examiner*—Cheryl N. Hawkins
(74) *Attorney, Agent, or Firm*—Howson & Howson

(57) ABSTRACT

In a coating film transfer tool in which a transferable film is carried by a tape base, tape breakage and non-uniform film application due to twisting are avoided by providing the tape supply and take-up reels in a cassette which also includes a fixed transfer head and mounting shafts. The cassette is disposed in a casing with its transfer head protruding out of the casing, and with its mounting shafts supported in bearings in the casing so that the cassette and transfer head can rotate relative to the casing. Since the tape cassette is rotatable integrally with the tape and the transfer head, when the transfer head is rotated to follow a tape-receiving surface, the tape does not become twisted.

6 Claims, 8 Drawing Sheets

COATING FILM TRANSFER TOOL

FIELD OF THE INVENTION

This invention relates to the transfer of coating films, and more particularly to improvements in manually operated transfer tools for applying correction films, adhesive films, decorative coating films and the like, wherein the film is supplied on a tape base material and transferred from the tape base material onto a sheet or other coating-receiving surface.

BACKGROUND OF THE INVENTION

In a typical film transfer tool, a tape consisting of a tape base material and a transferable film is provided on a rotatable core as a tape supply reel within a casing. The base material of the tape (also sometimes referred to as a "backing") extends around a laterally extending, tape-pressing edge of a transfer head and thence to a take-up reel also located within the casing. In operation of the device, the tape is unwound from the supply reel and wound onto the take-up reel as the tape-pressing edge is drawn across a coating-receiving surface. The film is separated from the tape base material at the location of the tape-pressing edge, and transferred onto the coating-receiving surface as a result of pressure applied by the tape-pressing edge. The transfer head is pivoted to the casing so that the tape pressing edge is maintained in parallel relationship to the surface to which the film is to be transferred, even though the casing may be tilted.

The pivoting action of the transfer head has an important advantage in that it produces more uniform application of the film to the receiving surface even when the casing is tilted. However, the pivoting action of the transfer head, also has a disadvantage. If the casing is tilted about the pivot axis of the transfer head, the length of tape extending from the supply reel to the tape pressing edge, and the length of tape base extending from tape pressing edge to the take-up reel can twist. Excessive twisting of the tape or tape base can result in disengagement of the tape from the tape pressing edge, and can even result in breakage of the tape. Twisting of the tape can also impair the uniformity of the film applied to the coating-receiving surface.

SUMMARY OF THE INVENTION

An important object of the invention, therefore, is to provide a coating film transfer tool which exhibits the advantages of the conventional tools having a pivoted transfer head, but which eliminates the problems of disengagement and breakage associated with the pivoted transfer head.

The coating film transfer tool in accordance with the invention comprises a tape supply reel in the form of a core on which is wound a transfer tape comprising a tape base material with a transferrable coating film on one side of the base material, a transfer head having a pressing transfer part for transferring the coating film onto a film-receiving surface, and a take-up reel comprising a core onto which the tape base material is wound after transfer. The improvement resides in the fact that the supply reel and take-up reel are disposed rotatably in a tape cassette to which the transfer head is fixed, a casing is included to receive the tape cassette, the casing has two bearing members disposed on a common axis, the tape cassette has a transfer shaft and a support shaft also disposed on the common axis, and the transfer shaft and the support shaft are supported rotatably in the respective bearing members.

According to the invention, the tape cassette itself, which has within it the tape supply and take-up reels, the transfer tape, and the transfer head, are all integrally rotatable relative to the casing. Consequently, in the operation of the device, the transfer tape is not twisted, and disengagement of the tape from the transfer head, and tape breakage due to twisting, are avoided. Moreover, the avoidance of twisting of the tape ensures smooth and uniform application of the transferrable film to the coating-receiving surface.

In a preferred embodiment of the coating film transfer tool according the invention, the pressing transfer part is displaced from the common axis, so that the pressing transfer part can be positioned between the common axis and the receiving surface. The displacement of the pressing transfer part from the axis of rotation of the tape cassette improves the visibility of the location of the tip of the tape transfer head and of the uncoated surface immediately ahead of the tip. Moreover, in the preferred embodiment, each of the bearing members preferably comprises projections which extend toward the common axis, the projections of each bearing member being in point contact with the shaft supported therein.

Other objects, details and advantages of the invention will be apparent from the following detailed description when read in conjunction with the drawings.

DETAILED DESCRIPTION

Figure 13:
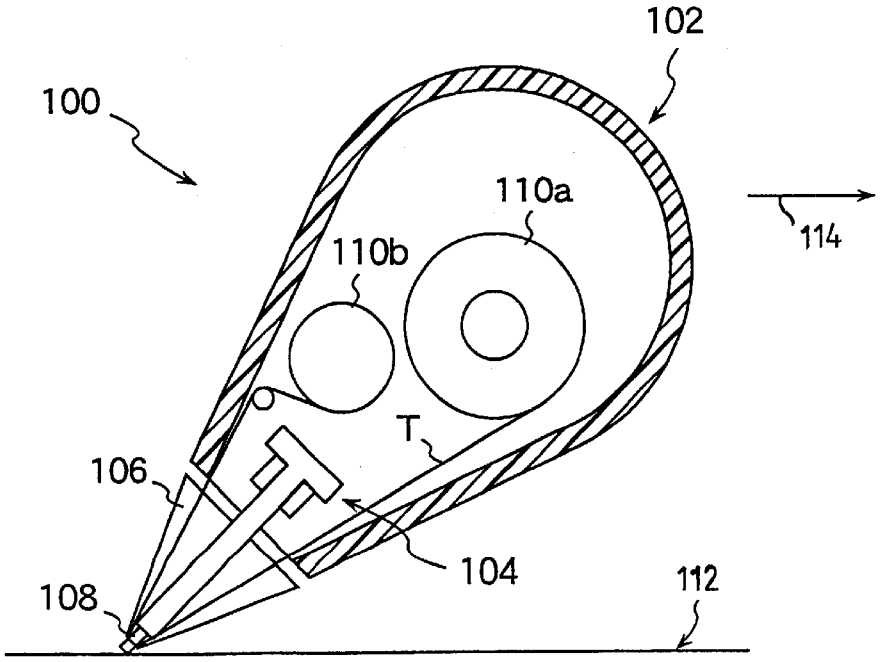
FIG. 13 PRIOR ART
FIG. 13 is a longitudinal cross-sectional view of a conventional coating film transfer tool.

The common features of the invention and the prior art, and the significance of the differences between the invention and the prior art, can be better appreciated by a more detailed examination of the prior art. Therefore, referring first to FIG. 13, a typical conventional coating film transfer tool 100 comprises a transfer head 106 disposed on a pivot shaft 104 which is rotatably supported in a casing 102 so that the transfer head can rotate, at least to a limited degree, relative to the casing. A pressing transfer part 108, which has a laterally tip portion, is formed on the transfer head, and protrudes a short distance beyond the end of the of the transfer head 106.

Two tape cores 111*a* and 110*b* are provided within casing 102. Core 111*a* is a tape supply core carrying a supply of tape T, which consists of a tape base coated with a coating film. Core 110*b* is a take-up core for reeling the tape base after the coating has been transferred from the tape base to a coating-receiving surface 112.

The transfer tape, which is unwound from the tape supply core 110*a,* passes over part 108 with its coated side facing outward. Before the tape reaches the opposite, or "return," side of the transfer part 108, the coating is separated from the tape base and transferred onto the receiving surface 112 as a result of pressure applied by the transfer part 108 as part 108 is pressed against and moved over the receiving surface. Only the tape base material is reeled around core 110*b,* the coating having been removed from the base material at the location of the transfer part 108.

When the coating film transfer tool 100 is used, the casing 102 is gripped by hand and the pressing transfer part 108 is drawn in the direction indicated by arrow 114 over the region of surface 112 to which the film is to be applied. The supply core 110*a* is rotated in the unwinding direction by the tangential force exerted on it by tape T as the transfer part is drawn across surface 112. The take-up core 110*b* is rotated in the winding direction as core 110*a* rotates in the unwinding direction, by virtue of mechanical connection, e.g. a driving band, (not shown) connected between cores 110*a* and 110*b*.

Because the transfer head 106 is pivoted, pressure applied to the casing 102 as the device is drawn across surface 112, maintains the laterally extending tip portion of transfer part 108 in parallel relationship to surface 112. Consequently, the transfer part applies a uniform pressure to the tape with the objective of achieving smooth and complete application of the film to surface 112. Thus, the pivoting action of the transfer head has an important advantage in that it produces smoother and more uniform application of the film to the surface even when the casing is tilted. However, as pointed out previously, the pivoting action of the transfer head, also has a disadvantage because, if the casing 102 is tilted about the axis of pivot shaft 104, the lengths of tape extending from tape supply core 110*a* to transfer part 108 and from transfer part 108 to take-up core 110*b* can twist. Excessive twisting of the tape can cause the tape to disengage from the pressing transfer part 108, and can even result in breakage of the tape. Furthermore, twisting of the tape can result in non-uniform application of the film to a coating-receiving surface.

Figure 1A:
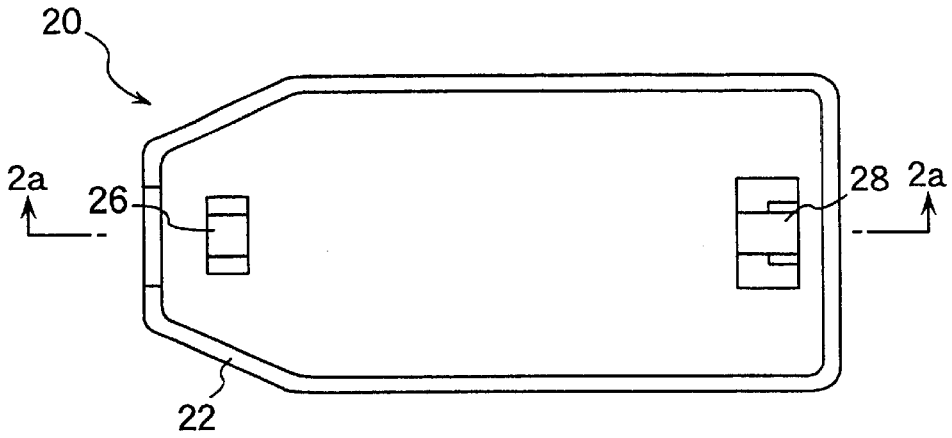
FIG. 1A is a longitudinal cross-sectional view of a casing of a coating film transfer tool in accordance with a first embodiment of the invention.
Figure 2A:
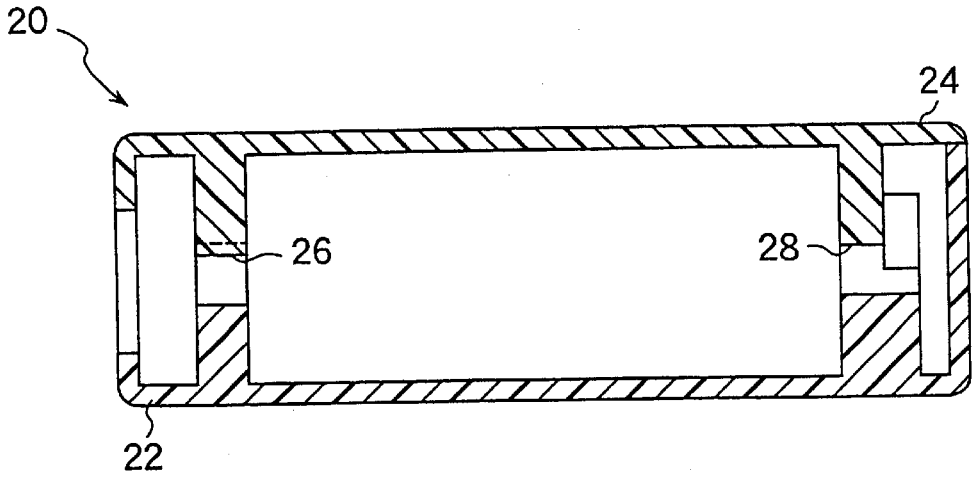
FIG. 2A is a lateral cross-sectional view of the casing, taken on plane 2A—2A in FIG. 1A.
Figure 5:
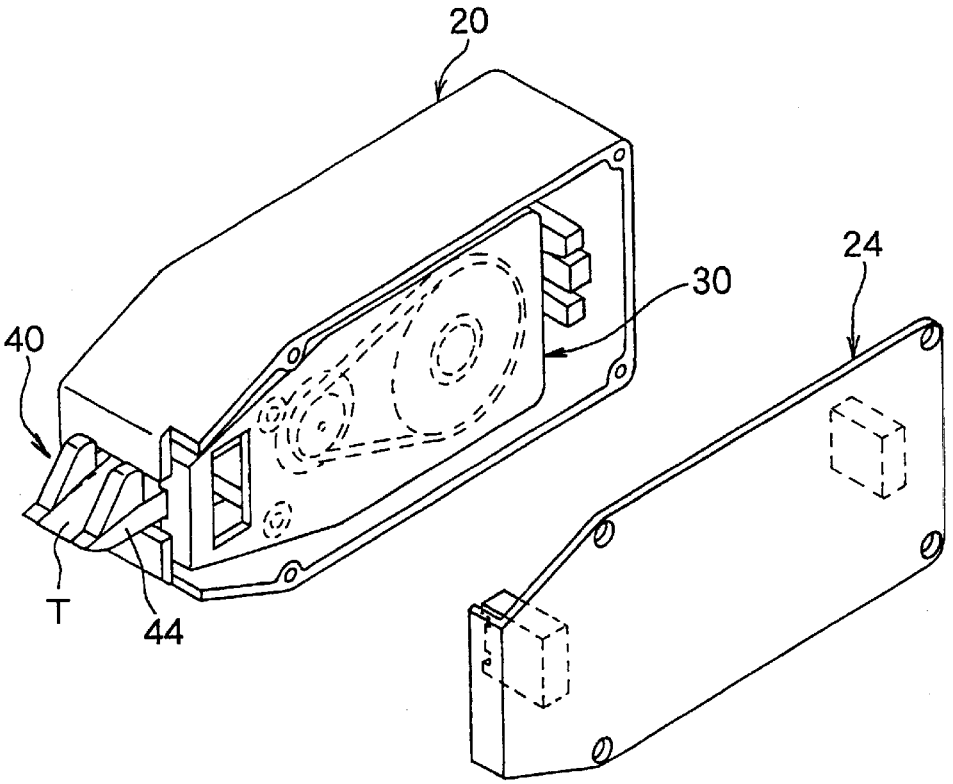
FIG. 5 is a dismantled perspective view of the coating film transfer tool of the first embodiment.

Referring now to FIG. 1A, the casing 20 of the first embodiment of the invention comprises a main body 22. Parts of bearings 26 and 28 are formed on a wall of the casing respectively adjacent opposite ends of the casing. A cover 24, as shown in FIGS. 2A and 5, fits onto the main body 22. The cover has complementary bearing parts which, in cooperation with the bearing parts in the main body, form the complete bearings 26 and 28. The bearings are provided for the purpose of supporting shafts on the tape cassette which will be housed in the casing.

Figure 1B:
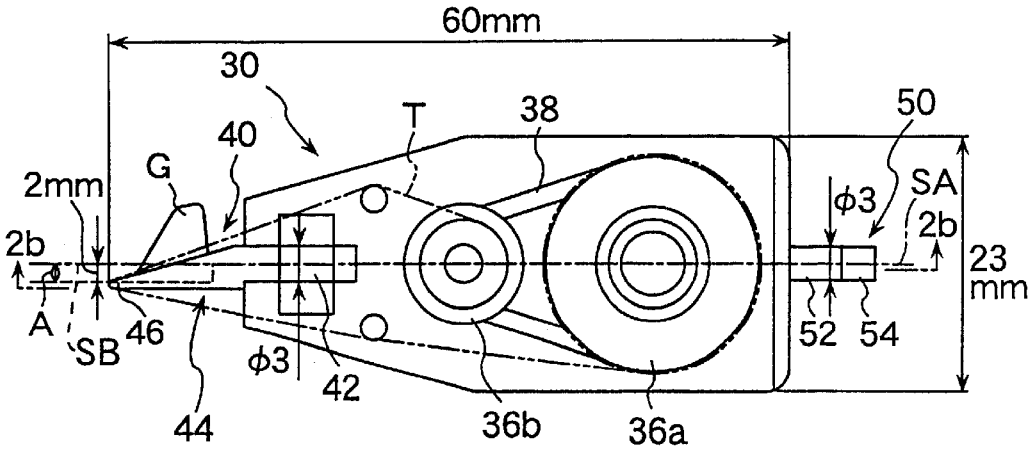
FIG. 1B is a longitudinal cross-sectional view of a tape cassette to be received in the casing of FIG. 1A.
Figure 2B:
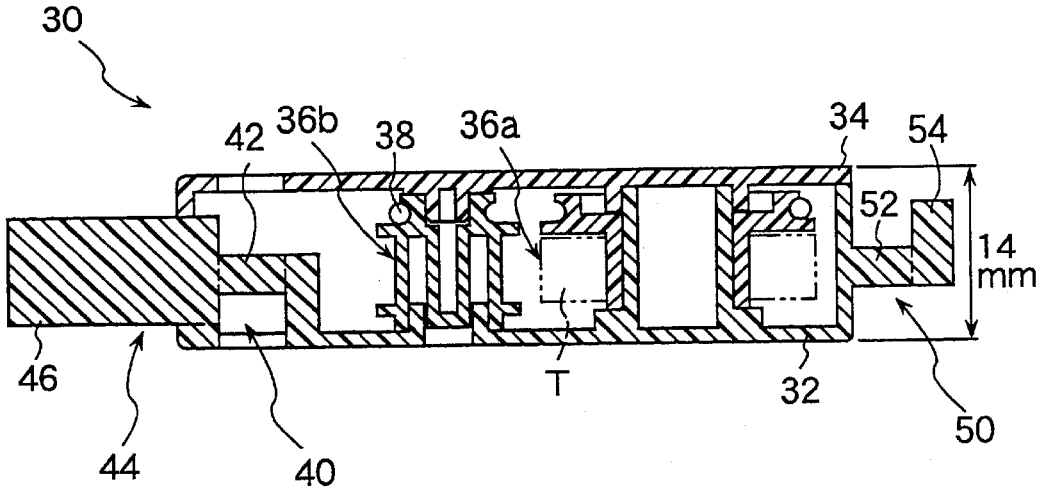
FIG. 2B is a cross-sectional view of the tape cassette taken on surface 2B—2B of FIG. 1B, with the tape omitted.
Figure 6:
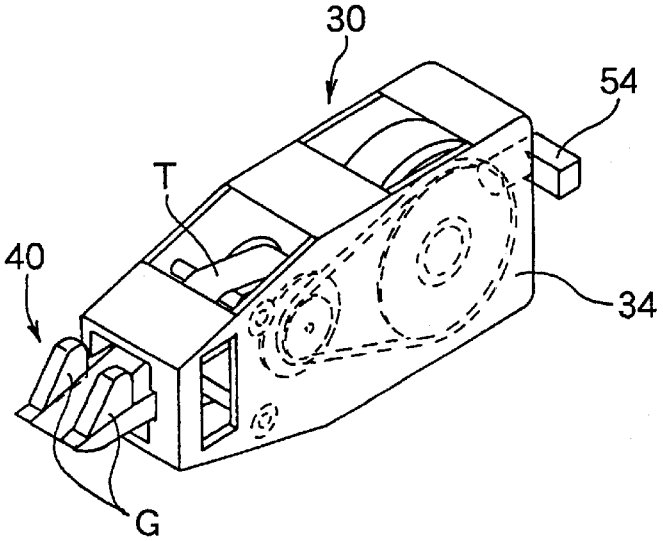
FIG. 6 is a perspective view showing the tape cassette of the first embodiment.

As shown in FIGS. 1B, 2B and 6, the tape cassette 30 comprises a box-shaped main body 32 (FIG. 2B) and a cover 34 (FIGS. 2B and 6). A tape supply core 36*a* and a take-up core 36*b* are rotatably mounted on spindles in the main body 32. The cores are preferably connected to each other for cooperative rotation by an rubber band 38 in the form of a loop, although alternatively they can be made mutually rotatable by gearing.

A transfer shaft 40 is fixed within the main body 32 of the cassette. The transfer shaft includes a cylinder-shaped part 42 within the cassette and a transfer head 44 protruding outwardly from the main body 32 of the cassette. As will be apparent from FIGS. 1B and 2B, the cylinder-shaped part 42 of the transfer shaft is located within the loop of tape extending from the supply reel, and around the transfer head, to the take-up reel. Apertures are provided in the walls of the cassette to allow clearance for the supports of bearing 26 in which the cylinder-shaped part 42 of the transfer shaft is supported rotatably.

A pressing transfer part 46, having laterally extending edge at its tip, is provided on the transfer head 44. A pair of tape guides G (FIGS. 1B and 6) are formed opposite to each other on the transfer head.

Figure 3:
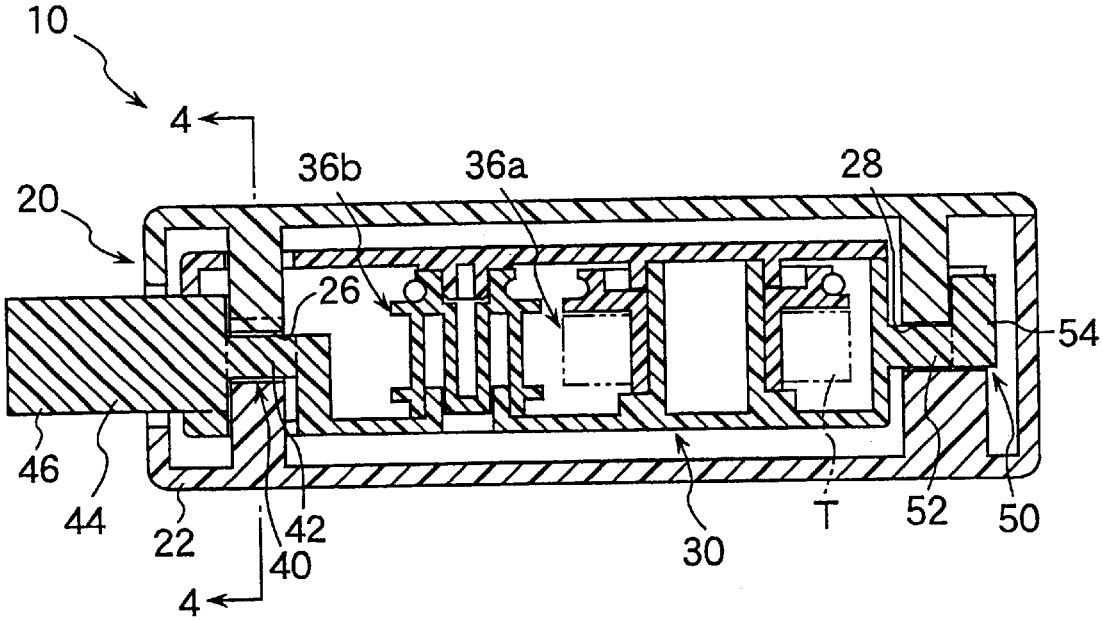
FIG. 3 is a lateral cross-sectional view of a coating film transfer tool in accordance with the first embodiment, in which the tape cassette is shown accommodated within the casing.
Figure 4:
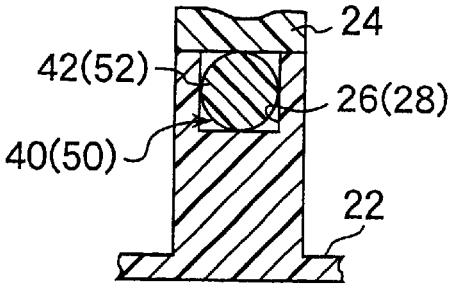
FIG. 4 is a fragmentary cross-sectional view taken on plane 4—4 of FIG. 3, showing the transfer shaft of the cassette supported by a bearing in the casing.

The cylindrical part 42 of the transfer shaft 40 is supported by bearing 26 in casing 20, as illustrated in FIGS. 3 and 4. The transfer head 44 and the pressing transfer part 46 of the tape cassette protrude outwardly from and end portion of the casing, as shown in FIGS. 3 and 5.

Further, as illustrated in FIG. 1B, a support shaft 50 protrudes from the end of the cassette opposite to the end at which the transfer head is located. The support shaft 50 has a cylinder-shaped support shaft 52, which is engageable in bearing 28 in the main body 22 of the casing, as shown in FIG. 3. The support shaft 50 has a key-shaped projection 54 formed at its end. The projection 54, in cooperation with parts of the bearing 26 limits the rotation of the cassette within the casing, and also keeps the support shaft 50 from disengaging from the bearing 28.

In the tape cassette 30, a transfer tape T, which comprises a tape base material and a coating film on the tape base material, is provided as a coil on core 36*a,* with the coating film on the outward face of the base material. As shown in FIG. 1B, the base material of the tape T passes over the pressing transfer part 46 at the tip of the transfer head 44, with its coated side facing outward. At the location of the pressing transfer part 46, the coating film is separated from the base as the transfer part is pressed against and drawn over a surface. The film is transferred to the surface while the base continues toward, and is wound onto, the take-up core 36*b*.

As shown in FIG. 1B, the shafts 40 and 50 are aligned with each other on a common axis SA. The width of the transfer head 44 is greater than the diameters of shafts 40 and 50. The pressing edge of the transfer part 46 is offset from axis SA by a distance A (FIG. 1B) in the direction toward the coating-receiving surface. Therefore an axis SB extending along the bottom of the transfer part 46 is parallel to, but spaced by a distance A from, the common axis SA of shafts 40 and 50. The transfer pressing part and the cassette, therefore, take the form of a crank with axes SA and SB separated from each other by a distance A. The distance A can be made relatively large, with the result that the distance between the casing and the coating-receiving surface is increased for greater visibility of the position of the tip of the transfer head and of the adjacent area of the surface about to be coated. The fact that the transfer head rotates with the cassette simplifies the achievement of a relatively large offset for greater visibility, and also avoids the excessive twisting that would result from an attempt to achieve improved visibility by a relatively large offset in a conventional film transfer tool.

Figure 8:
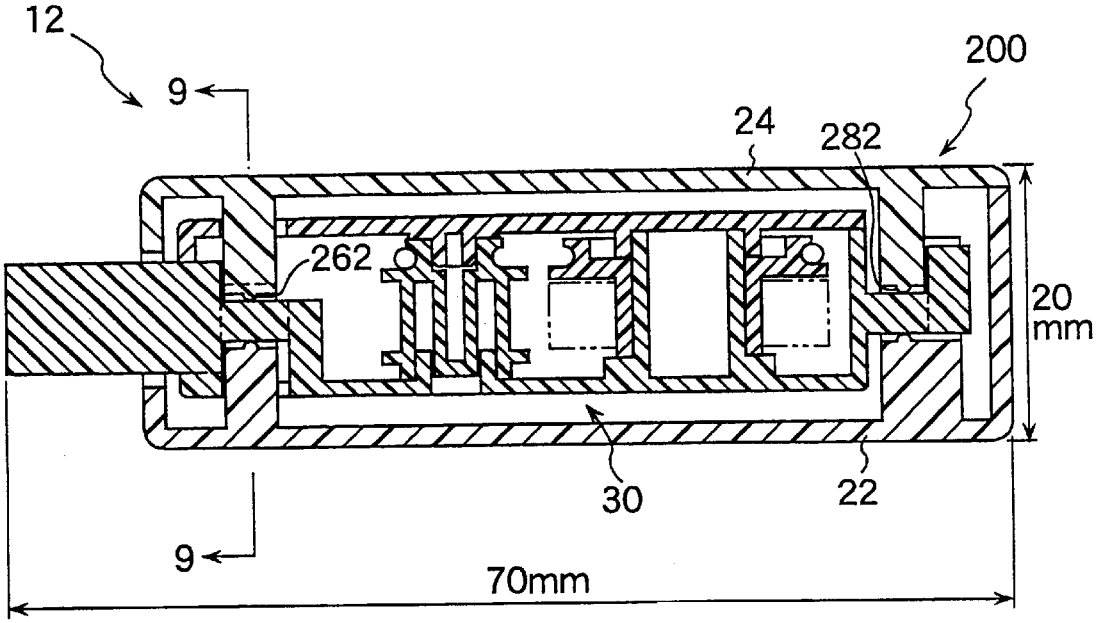
FIG. 8 is a lateral cross-sectional view of a coating film transfer tool in accordance with the second embodiment, in which the tape cassette is shown accommodated within the casing.
Figure 9:
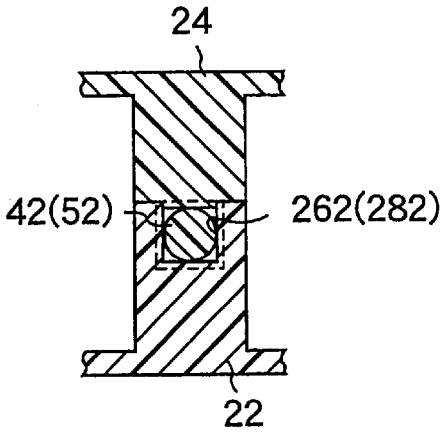
FIG. 9 is a cross-sectional view taken on plane 9—9 of FIG. 8, showing the transfer shaft of the cassette supported by a bearing in the casing.

Typical dimensions of the coating film transfer tool are shown in FIGS. 1B, 2B and 8.

The coating transfer tool in accordance with the invention is used in the same way as a conventional transfer tool. In use, if the casing 20 is rotated relative to the coating-receiving surface about axis SA, the pressing transfer part 46, which is rotatable relative to the casing, can remain in parallel relationship to the coating-receiving surface. However, unlike the conventional coating transfer tool of FIG. 13, the transfer tool of the invention allows the tape cassette to rotate with the transfer head so that the tape cassette and the transfer head both rotate together relative to the casing. Consequently, the tape T will not run aslant and is not likely to become twisted or break, as is the case with conventional film transfer tools. The provision of a cassette rotatable on bearings in a casing not only prevents twisting of the tape, but also simplifies the offsetting of the transfer head from its rotation axis for improved visibility of the location of the tip and the adjacent coating-receiving surface.

In the use of the tool, when the transfer tape is used up, i.e. when all of the available film has been transferred, the entire cassette, including the exhausted tape base can be discarded and replaced as a unit with a fresh cassette supplied already charged with a new tape.

Referring now to FIGS. 7A, 7B, 8 and 9, in the transfer tool 12 in accordance with the second embodiment of the invention, a casing 200 receives a tape cassette 30, which is essentially the same as the tape cassette 30 of the first embodiment, and is used in the same way.

Figure 7A:
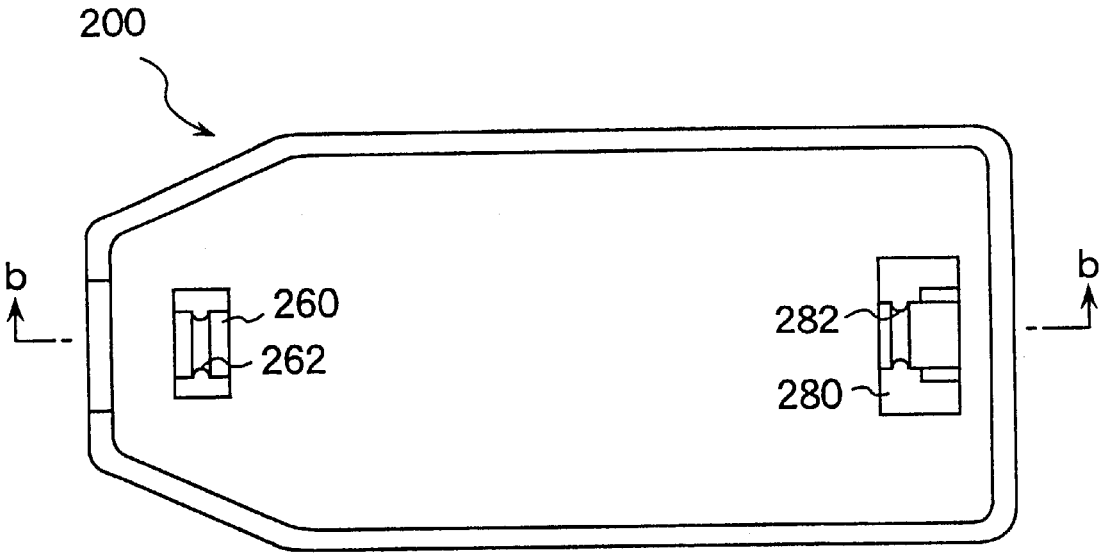
FIG. 7A is a longitudinal cross-sectional view of a casing of a coating film transfer tool in accordance with a second embodiment of the invention.
Figure 7B:
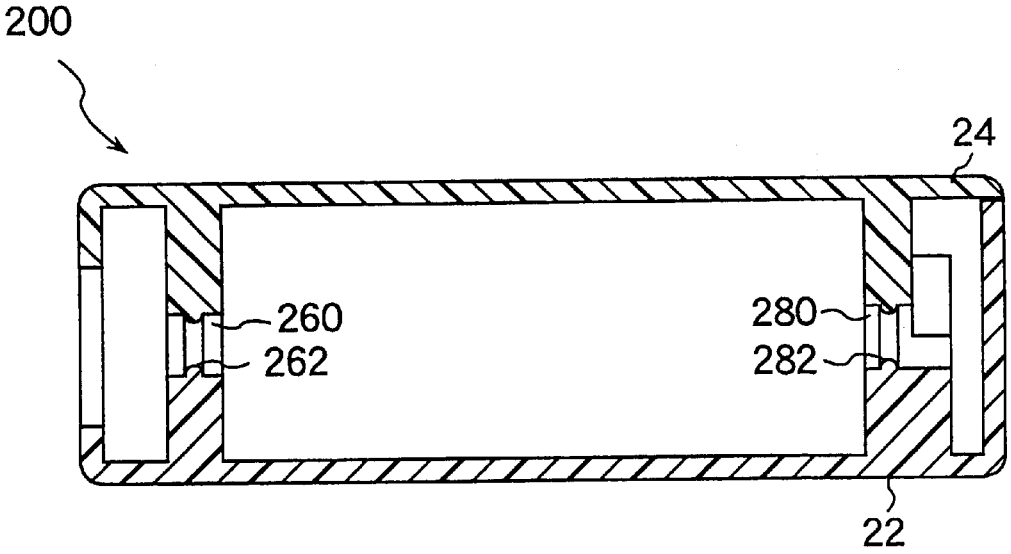
FIG. 7B a lateral cross-sectional view of the casing of FIG. 7A, taken on plane B—B in FIG. 7A.

The casing, as shown in FIGS. 7A and 7B, comprises a main body 22 and a lid 24, as in the first embodiment. Its bearings 260 and 280 are constituted by cooperating elements formed on the main body and lid. The second embodiment differs from the first embodiment in that its bearings 260 and 280 are formed with projections 262 and 282 respectively, which have convex, curved cross-sections.

As shown in FIG. 8, the tape cassette 30 is received in the casing 200, with its transfer shaft and its support shaft rotatably supported by the convex bearing surfaces 262 and 282 respectively. As seen in the cross-sectional view of FIG. 9, the cylindrical parts 42 and 52 of the transfer shaft and support shaft of the cassette are supported in bearings formed by cooperating parts of the casing.

In the first embodiment, as shown in FIG. 4, the cylindrical parts 42 and 52 of shafts 40 and 50 are in linear contact with the bearing members 26 and 28 respectively. That is, the contact at the bearing surface takes place essentially along four lines extending parallel to the axes of the cylindrical parts. In contrast, the cylindrical parts of the shafts in the second embodiment are in point contact with the bearing members. That is, contact takes place essentially at four points (in reality, very small areas of contact). As a result, the friction between the shafts and the bearing surfaces is reduced, and the tape cassette can be rotated in the casing more smoothly, and with less applied force.

The cross-sectional shape of the projections of the bearing members need not be curved to achieve the effect of point contact between the bearings and the shafts. For example, projections having triangular cross-sections can be used with the same effect. The projections can also be of various other shapes, such as spherical, triangularly pyramidal, conical, or in the form of truncated cones.

As in the case of the first embodiment, since the tape cassette 30 is rotated integrally with the transfer tape T relative to the casing 200, the transfer tape T is not twisted at all when its film is transferred to the coating-receiving surface.

Figure 10A:
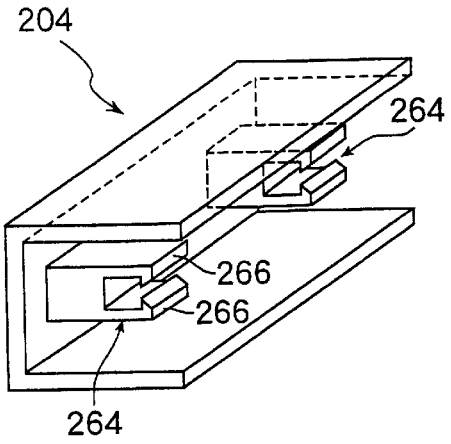
FIG. 10A is a perspective view of the casing of a coating film transfer tool in accordance with a third embodiment of the invention.
Figure 10B:
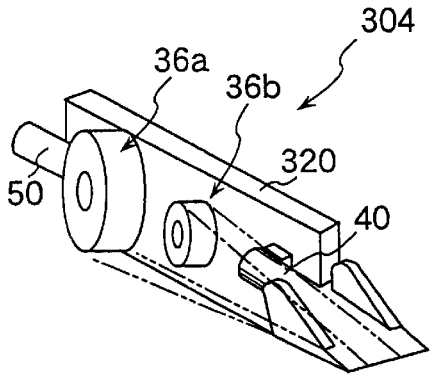
FIG. 10B is a perspective view of a tape cassette to be received in the casing of FIG. 10A.
Figure 11A:
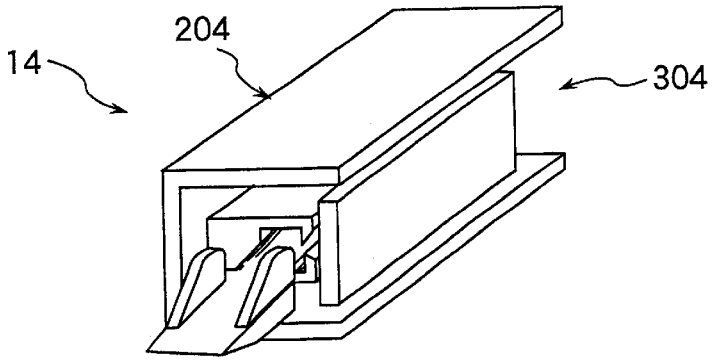
FIG. 11A is a perspective view of an assembled coating film transfer tool in accordance with the third embodiment.
Figure 11B:
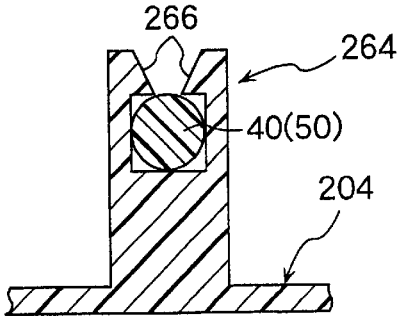
FIG. 11B is a cross-sectional view illustrating the manner in which the transfer shaft of the tape cassette of FIG. 10B fits into a transfer shaft bearing of FIG. 10A.

The structures of the above-described coating film transfer tools can be further simplified. For example, FIGS. 10A and 10B, show a coating film transfer tool in accordance with a third embodiment of the invention, in which the casing 204 has a U-shaped cross-section and the tape cassette 304 comprises a plate-shaped main body 320, on which a tape supply core 36*a* and a take-up core 36*b* are mounted rotatably. The transfer shaft 40 and support shaft 50 are provided on the plate-shaped, main body 320, and aligned with each other along a common axis which extends longitudinally through the plate itself. Hooks 266, formed on the bearing members 264, hold the shafts to the bearing members and thereby hold the tape cassette in the U-shaped casing, as shown in FIG. 11B. The cassette can be inserted into the casing by exerting a lateral force to engage the shafts in the bearings, taking advantage of elastic deformation of the hook elements of the bearings. Moreover, the exhausted cassette can be removed from the casing by exerting a lateral force in the opposite direction to disengage the shafts from the bearings.

Figure 12:
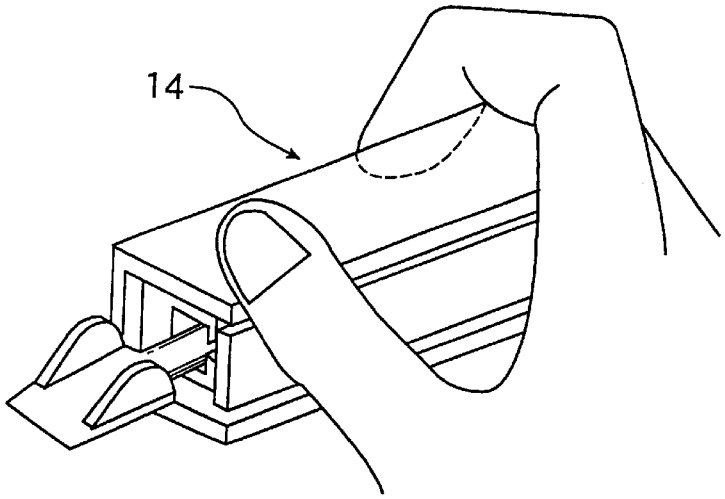
FIG. 12 is a perspective view showing the coating film transfer tool of the third embodiment in use.

In FIG. 12, which shows the coating film transfer tool of the third embodiment in use, it is seen that the plate-shaped body 320 of the tape cassette also functions as a closure for the casing. As plate 320 is exposed, the tool should be gripped in such a way as not to hinder the rotation of plate. Plate 320 and its transfer head can rotate together about the common axis of shafts 40 and 50 because the common axis of shafts 40 and 50 extends longitudinally through the plate itself. Consequently the plate can rotate about the axis of shafts 40 and 50 without translating upward or downward in the U-shaped casing 204.

In the third embodiment, as in the case of the first and second embodiments, since the tape cassette 304 is rotated integrally with the transfer tape, the tape is not twisted in the process transferring a coating film to a receiving surface, and consequently twisting, breakage of the tape and other failures are avoided, and the film coating is applied more smoothly and more effectively.

The third embodiment is simpler than the first and second embodiments, and has fewer parts. Consequently, its cost of production can be less than the cost of production of the first two embodiments. Moreover, as the casing of the third embodiment is not provided with its own lid, the tape cassette can be removed and replaced more easily.

Various modifications can be made to the device described. For example, a cassette such as the one shown in FIG. 2B can be installed in a casing having snap-in bearings of the kind shown in FIG. 11B. Other modifications may be made to the apparatus and method described above without departing from the scope of the invention as defined in the following claims.

What is claimed is:

1. A coating film transfer tool comprising a tape supply core on which a transfer tape having a coating film on one side of a tape base material is wound, a transfer head formed with a pressing transfer part to transfer the coating film onto a receiving surface, and a take-up core for reeling the tape base material after transfer, characterized in that a tape cassette including the tape supply core and take-up core rotatably and the transfer head fixedly is received in a casing formed with two bearing members, the tape cassette having a transfer shaft and a support shaft, the transfer shaft and the support shaft being supported rotatably in the bearing members.

2. A coating film transfer tool comprising:

a tape supply reel comprising a core on which is wound a transfer tape comprising a tape base material with a transferable coating film on one side of the base material;

a transfer head having a pressing transfer part for transferring the coating film onto a receiving surface; and a take-up reel comprising a core for reeling the tape base material after transfer;

wherein the tape supply reel and the take-up reel are disposed rotatably in a tape cassette to which the transfer head is fixed, and including a casing receiving the tape cassette, the casing having two bearing members disposed on a common axis, the tape cassette having a transfer shaft and a support shaft also disposed on the common axis, the transfer shaft and the support shaft being supported rotatably in the respective bearing members, whereby the tape cassette and the transfer head can rotate together relative to the casing about the common axis and twisting of the tape is avoided.

3. A coating film transfer tool according to claim 2, in which the pressing transfer part is displaced from the common axis, whereby the pressing transfer part can be positioned between the common axis and the receiving surface for improved visibility of the tape transfer part and portions of a coating-receiving surface adjacent thereto.

4. A coating film transfer tool according to claim 2, in which each of the bearing members comprises projections which extend toward the common axis, the projections of each bearing member being in point contact with the shaft supported therein.

5. A coating film transfer tool according to claim 4, in which the pressing transfer part is displaced from the common axis, whereby the pressing transfer part can be positioned between the common axis and the receiving surface for improved visibility of the tape transfer part and portions of a coating-receiving surface adjacent thereto.

6. A coating film transfer tool according to claim 2, in which each of the bearing members comprises projections which extend toward the common axis, the shapes of the projections of each bearing member being from the group of shapes consisting of spherical, triangularly pyramidal, conical and truncated conical.

* * * * *

UNITED STATES PATENT AND TRADEMARK OFFICE

CERTIFICATE OF CORRECTION

PATENT NO. : 6,363,990 B1
DATED : April 2, 2002
INVENTOR(S) : Hiroshi Kozaki

It is certified that error appears in the above-identified patent and that said Letters Patent is hereby corrected as shown below:

Column 3,
Line 24, change "111a" to -- 110a --;
Line 25, change "111a" to -- 110a --;

Signed and Sealed this

Eighteenth Day of June, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,363,990 B1
DATED : April 2, 2002
INVENTOR(S) : Kozaki

It is certified that error appears in the above-identified patent and that said Letters Patent is hereby corrected as shown below:

Title page,
Item [*] Notice, delete the pharse “by 0 days” and insert -- by 133 days --

Signed and Sealed this

Thirtieth Day of March, 2004

JON W. DUDAS
*Acting Director of the United States Patent and Trademark Office*